US005140297A

United States Patent [19]

Jacobs et al.

[11] Patent Number: 5,140,297

[45] Date of Patent: Aug. 18, 1992

[54] PTC CONDUCTIVE POLYMER COMPOSITIONS

[75] Inventors: Stephen M. Jacobs, Cupertino; Mary S. McTavish, Fremont; Frank A. Doljack, Pleasanton, all of Calif.

[73] Assignee: Raychem Corporation, Menlo Park, Calif.

[21] Appl. No.: 531,972

[22] Filed: Jun. 1, 1990

Related U.S. Application Data

[60] Division of Ser. No. 146,652, Jan. 21, 1988, Pat. No. 4,951,384, which is a continuation of Ser. No. 656,046, Sep. 28, 1984, abandoned, which is a continuation of Ser. No. 364,179, Apr. 1, 1982, abandoned, which is a continuation-in-part of Ser. No. 250,491, Apr. 2, 1981, abandoned.

[51] Int. Cl.[5] ..... H01C 7/10; H05B 1/02

[52] U.S. Cl. ..... 338/22 R; 219/505

[58] Field of Search ..... 338/22 R, 22 SD, 25; 361/103, 106; 219/553, 549, 448, 505

[56] References Cited

U.S. PATENT DOCUMENTS

| | | | |
|---|---|---|---|
| 2,759,092 | 8/1956 | Fortin | 29/611 |
| 2,777,044 | 1/1957 | Lytle | 29/611 |
| 3,243,753 | 3/1966 | Kohler | 338/322 |
| 3,311,862 | 3/1967 | Rees | 338/211 |
| 3,351,882 | 11/1967 | Kohler et al. | 219/505 |
| 3,448,246 | 6/1969 | Armbruster | 219/528 |
| 3,535,494 | 10/1967 | Armbruster | 219/528 |
| 3,858,144 | 12/1974 | Bedard et al. | 338/22 R |
| 3,861,029 | 1/1975 | Smith-Johannsen et al. | 39/611 |
| 4,177,376 | 12/1979 | Horsma et al. | 219/553 |
| 4,238,812 | 12/1980 | Middleman et al. | 361/106 |
| 4,239,608 | 12/1980 | Pantelis | 204/159 |
| 4,277,673 | 7/1981 | Kelly | 219/528 |
| 4,286,376 | 9/1981 | Smith-Johannsen et al. | 29/611 |
| 4,323,875 | 4/1982 | Tentarelli et al. | 338/25 |
| 4,334,351 | 6/1982 | Sopory | 29/611 |
| 4,388,607 | 6/1983 | Toy et al. | 338/22 SD |
| 4,445,026 | 4/1984 | Walker | 219/553 |

FOREIGN PATENT DOCUMENTS

| | | |
|---|---|---|
| 00008235 | 2/1980 | European Pat. Off. . |
| 2321751 | 3/1976 | France . |
| 2368127 | 10/1977 | France . |
| 2423037 | 4/1979 | France . |

*Primary Examiner*—Marvin M. Lateef
*Attorney, Agent, or Firm*—Timothy H. P. Richardson; Marguerite E. Gerstner; Herbert G. Burkard

[57] ABSTRACT

Conductive polymer PTC compositions have improved properties, especially at voltages of 200 volts or more, if they are very highly cross-linked by means of irradiation, for example to a dosage of at least 50 Mrads, preferably at least 80 Mrads, e.g. 120 to 600 Mrads. The cross-linked compositions are particularly useful in circuit protection devices and layered heaters.

21 Claims, 3 Drawing Sheets

PTC CONDUCTIVE POLYMER COMPOSITIONS

CROSS REFERENCE TO RELATED APPLICATIONS

This application is a division of copending application Ser. No. 146,652, filed Jan. 21, 1988, now U.S. Pat. No. 4,951,384 which is a continuation of application Ser. No. 656,046, filed on Sep. 28, 1984, now abandoned, which is a continuation of application Ser. No. 364,179, filed on Apr. 1, 1982, now abandoned, which is a continuation-in-part of application Ser. No. 250,491 filed Apr. 2, 1981, now abandoned. This application is also related to copending application Ser. Nos. 07/146,653 and 07/146,654, both filed Jan. 21, 1988, and to copending application Ser. No. 07/292,965, filed Jan. 3, 1989, which is a divisional application of application Ser. No. 07/146,460, filed Jan. 21, 1988, now U.S. Pat. No. 4,845,838. The entire disclosure of each of these applications is incorporated by reference herein.

BACKGROUND OF THE INVENTION

1. Field of the Invention

This invention relates to radiation cross-linked conductive polymer PTC compositions and devices comprising them.

2. Introduction to the Invention

Conductive polymer compositions, and devices comprising them, have been described in published documents and in previous applications assigned to the same assignee. Reference may be made for example to U.S. Pat. Nos. 2,978,665 (Vernet et al.), 3,243,753 (Kohler), 3,351,882 (Kohler et al), 3,571,777 (Tully), 3,793,716 (Smith-Johannsen), 3,823,217 (Kampe), 3,861,029 (Smith-Johannsen), 4,017,715 (Whitney et al), 4,177,376 (Horsma et al), 4,237,441 (Van Konynenburg et al), 4,246,468 (Horsma) and 4,272,471 (Walker); U.K. Patent No. 1,534,715; the article entitled "Investigations of Current Interruption by Metal-filled Epoxy Resin" by Littlewood and Briggs in J. Phys D: Appl. Phys, Vol. II, pages 1457–1462; the article entitled "The PTC Resistor" by R. F. Blaha in Proceedings of the Electronic Components Conference, 1971; the report entitled "Solid State Bistable Power Switch Study" by H. Shulman and John Bartho (August 1968) under Contract NAS-12-647, published by the National Aeronautics and Space Administration; J. Applied Polymer Science 19, 813–815 (1975), Klason and Kubat; Polymer Engineering and Science 18, 649–653 (1978) Narkis et al; and commonly assigned U.S. Ser. Nos. 601,424 (Moyer), now abandoned, published as German OLS 2,634,999; 750,149 (Kamath et al), now abandoned, published as German OLS No. 2,755,077; 732,792 (Van Konynenburg et al), now abandoned, published as German OLS No. 2,746,602; 751,095 (Toy et al), now abandoned, published as German OLS No. 2,755,076; 798,154 (Horsma et al), now abandoned, published as German OLS No. 2,821,799; 965,344 (Middleman et al), published as German OLS No. 2,948,281 now U.S. Pat. No. 4,238,812; 965,345 (Middleman et al) now abandoned, published as German OLS No. 2,949,173; 6,733 (Simon), published as German OLS No. 3,002,721; 67,207 (Doljack et al), now abandoned, published as European Patent Application No. 26,571; 88,304 (Lutz), now abandoned, published as European Patent Application No. 28,142; 98,711 (Middleman et al) now U.S. Pat. No. 4,315,237; 141,984 (Gotcher et al) now abandoned, published as European Patent Application No. 38,718; 141,987 (Middleman et al) now U.S. Pat. No. 4,413,301; 141,988 (Fouts et al) now abandoned published as European Patent No. 38,713 141,989 (Evans); 141,991 (Fouts et al); U.S. Pat. No. 4,545,926 142,053 (Middleman et al); now U.S. Pat. No. 4,352,083 142,054 published as European Patent No. 38,713 (Middleman et al); now U.S. Pat. No. 4,317,027 (Sopory); now abandoned 150,910 (Sopory); now U.S. Pat. No. 4,334,351 150,911 (Sopory); now U.S. Pat. No. 4,318,881 254,352 (Taylor); now U.S. Pat. No. 4,426,633 300,709 (Van Konynenburg et al); now abandoned, published as European Patent Application No. 74,281 and the application filed on Feb. 17, 1982 by McTavish et al now U.S. Pat. No. 4,481,498. The disclosure of each of the patents, publications and applications referred to above is incorporated herein by reference.

Conductive polymer compositions are frequently cross-linked, e.g. by radiation, which is generally preferred, or by chemical cross-linking, in order to improve their physical and/or electrical characteristics. Compositions exhibiting PTC behavior, which are used in self-limiting heaters and circuit protection devices, are usually cross-linked to ensure that the resistivity of the composition remains at a high level as the temperature of the composition is increased above the switching temperature ($T_s$) of the composition. The extent of cross-linking which has been used in practice has in general been relatively low; thus the dose used in radiation cross-linking has typically been 10 to 20 Megarads. Cross-linking by radiation using higher doses has, however, been suggested in the literature. Thus U.S. Pat. No. 3,351,882 (Kohler et al) discloses the preparation of a resistor comprising a melt-extruded PTC conductive polymer element and two planar electrodes embedded therein, followed by subjecting the entire resistor to about 50 to 100 megarads of radiation of one to two million electron volt electrons in order to cross-link the conductive polymer, particularly around the electrodes. Ser. No. 601,424 (Moyer), now abandoned, published as German OLS 2,634,999, recommends radiation doses of 20 to 45 megarads to cross-link a PTC conductive polymer, thus producing a composition which has high peak resistance and maintains a high level of resistivity over an extended range of temperatures above $T_s$. U.K. Specification No. 1,071,032 describes irradiated compositions comprising a copolymer of ethylene and a vinyl ester or an acrylate monomer and 50–400% by weight of a filler, e.g. carbon black, the radiation dose being about 2 to about 100 Mrads, preferably about 2 to about 20 Mrads, and the use of such compositions as tapes for grading the insulation on cables.

SUMMARY OF THE INVENTION

This invention is concerned with improving the performance of electrical devices comprising conductive polymers, in particular PTC conductive polymers, which operate at a voltage of at least 200 volts. Thus the devices include for example self-limiting heaters and circuit protection devices which operate in circuits whose normal power source has a voltage of at least 200 volts and circuit protection devices which operate in circuits whose normal power source has a voltage below 200 volts, e.g. 110 volts AC or 30–75 volts DC, and which protect the circuit against intrusion of a power source having a voltage of at least 200 volts.

We have discovered that if the potential drop across a device comprising a radiation cross-linked PTC conductive polymer composition exceeds about 200 volts (voltages given herein are DC voltages or RMS values for AC power sources), the ability of the device to withstand cycling from a low resistance state to a high resistance state and back again (the high resistance state being induced by internal resistive heating) is critically dependent on the radiation dose used to cross-link the polymer.

In one aspect, the invention provides a process for the preparation of an electrical device comprising (a) a cross-linked PTC conductive polymer element and (b) two electrodes which can be connected to a source of electrical power to cause current to flow through the PTC element, said process comprising the step of irradiating the PTC element to a dosage of at least 120 Mrads.

In another aspect, the invention provides a process for the preparation of an electrical device which comprises the steps of (1) melt-extruding a radiation cross-linkable PTC conductive polymer composition around a pair of columnar electrodes; and
(2) irradiating the extrudate obtained in step (1) to a dosage of at least 50 Mrads.

In another aspect, the invention provides a process for the preparation of an electrical device which comprises the steps of (1) melt-extruding a radiation cross-linkable PTC conductive polymer composition to form a laminar extrudate which does not contain an electrode;
(2) irradiating the extrudate from step (1) to a dosage of at least 50 Mrads; and
(3) securing metal foil electrodes to the irradiated extrudate from step (2).

In another aspect, the invention provides a process for the preparation of an electrical device which comprises (1) melt-extruding a radiation cross-linkable PTC conductive polymer composition to form an extrudate which does not contain an electrode;
(2) dividing the extrudate from step (1) into a plurality of discrete PTC elements, each PTC element being in the form of a strip with substantially planar parallel ends;
(3) securing to each end of the PTC element an electrode in the form of a cap having (i) a substantially planar end which contacts and has substantially the same cross-section as one end of the PTC element and (ii) a side wall which contacts the side of the PTC element; and
(4) irradiating the PTC element to a dosage of at least 50 Mrads.

In another aspect, the invention provides a process for the preparation of an electrical device which comprises (1) forming a laminar PTC element of a radiation cross-linkable conductive polymer composition;
(2) securing electrodes to the laminar PTC element, the electrodes being displaced from each other so that at least a substantial component of current flow between the electrodes is along one of the large dimensions of the element; and
(3) irradiating the PTC element to a dosage of at least 50 Mrads.

Our experiments indicate that the higher the radiation dose, the greater the number of "trips" (i.e. conversions to the tripped state) a device will withstand without failure. The radiation dose is, therefore, preferably at least 60 Mrads, particularly at least 80 Mrads, with yet higher dosages, e.g. at least 120 Mrads or at least 160 Mrads, being preferred when satisfactory PTC characteristics are maintained and the desire for improved performance outweighs the cost of radiation.

We have further discovered a method of determining the likelihood that a device will withstand a substantial number of trips at a voltage of 200 volts. This method involves the use of a scanning electron microscope (SEM) to measure the maximum rate at which the voltage changes in the PTC element when the device is in the tripped state. This maximum rate occurs in the so-called "hot zone" of the PTC element. The lower the maximum rate, the greater the number of trips that the device will withstand.

In another aspect, the invention provides an electrical device which comprises (a) a radiation cross-linked PTC conductive polymer element and (b) two electrodes which can be connected to a power source to cause current to flow through the PTC element, said device when subjected to SEM scanning, showing a maximum difference in voltage between two points separated by 10 microns of less than 3 volts.

In another aspect, the invention provides an electrical device which comprises (a) a radiation cross-linked PTC conductive polymer element and (b) two columnar electrodes which are embedded in the PTC element and can be cohnected to a power source to cause current to flow through the PTC element, said device, when subjected to SEM scanning, showing a maximum difference in voltage between two points separated by 10 microns of less than 4.2 volts.

In another aspect, the invention provides an electrical device which comprises (a) a radiation cross-linked PTC conductive polymer element in the form of a strip with substantially planar parallel ends, the length of the strip being greater than the largest cross-sectional dimension of the strip;
(b) two electrodes, each of which is in the form of a cap having (i) a substantially planar end which contacts and has substantially the same cross-section as one end of the PTC element and (ii) a side wall which contacts the side of the PTC element;

said device, when subjected to SEM scanning, showing a maximum difference in voltage between two points separated by 10 microns of less than 4.2 volts.

BRIEF DESCRIPTION OF THE DRAWING

The invention is illustrated in the accompanying drawing, in which.

DETAILED DESCRIPTION OF THE INVENTION

Figure 1:
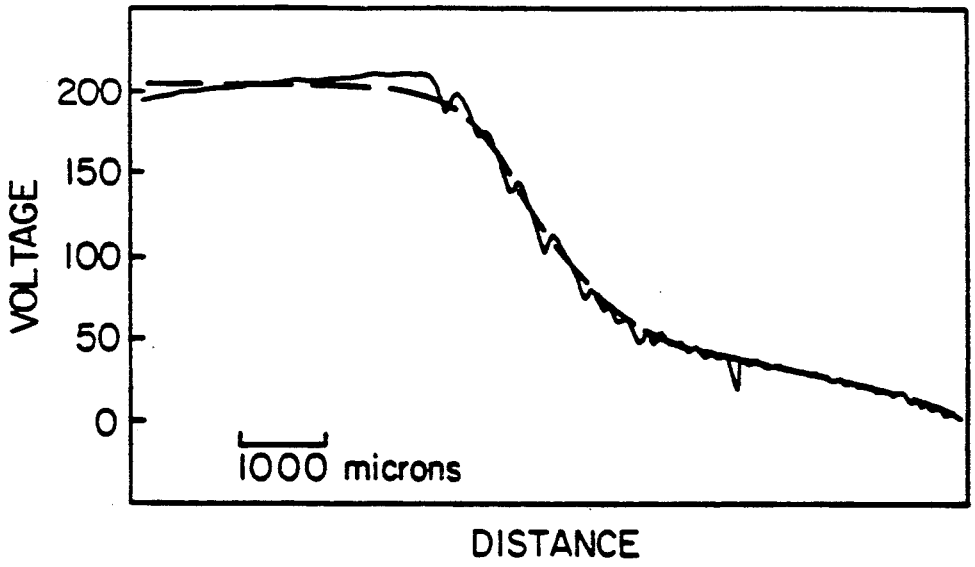
FIG. 1 is diagrammatic representation of a typical photomicrograph obtained in the SEM scanning of a device of the invention.

The term "SEM scanning" is used herein to denote the following procedure. The device is inspected to see whether the PTC element has an exposed clean surface which is suitable for scanning in an SEM and which lies between the electrodes. If there is no such surface, then one is created, keeping the alteration of the device to a minimum. The device (or a portion of it if the device is too large, e.g. if it is an elongate heater) is then mounted in a scanning electron microscope so that the electron beam can be traversed from one electrode to the other and directed obliquely at the clean exposed surface. A slowly increasing current is passed through the device, using a DC power source of 200 volts, until the device has been "tripped" and the whole of the potential dropped across it. The electron beam is then traversed across the surface and, using voltage contrast techniques known to those skilled in the art, there is obtained a photomicrograph in which the trace is a measure of the brightness (and hence the potential) of the surface between the electrodes; such a photomicrograph is often known as a line scan. A diagrammatic representation of a typical photomicrograph is shown in FIG. 1. It will be seen that the trace has numerous small peaks and valleys and it is believed that these are due mainly or exclusively to surface imperfections. A single "best line" is drawn through the trace (the broken line in FIG. 1) in order to average out small variations, and from this "best line", the maximum difference in voltage between two points separated by 10 microns is determined.

When reference is made herein to an electrode "having a substantially planar configuration", we mean an electrode whose shape and position in the device are such that substantially all the current enters (or leaves) the electrode through a surface which is substantially planar.

Figure 2:
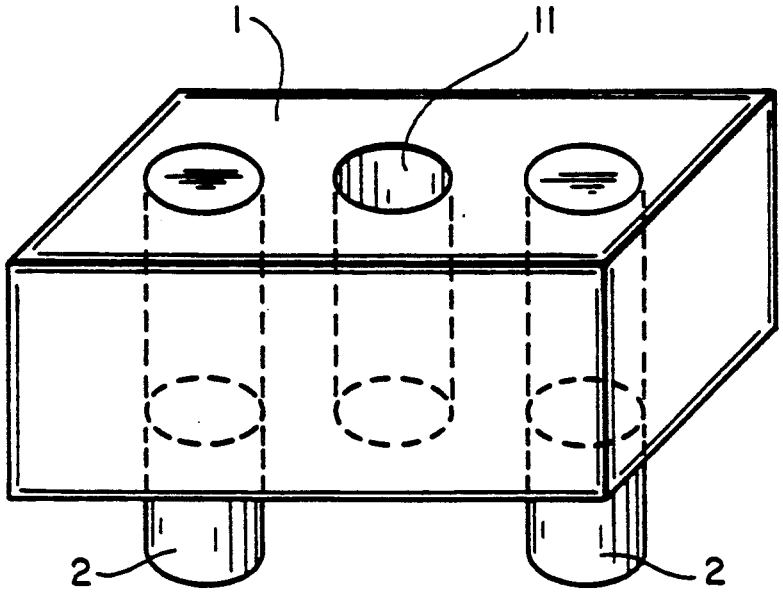
FIGS. 2, 3, 4 and 5 illustrate devices of the invention.

The present invention is particularly useful for circuit protection devices, but is also applicable to heaters, particularly laminar heaters. In one class of devices, each of the electrodes has a columnar shape. Such a device is shown in isometric view in FIG. 2, in which wire electrodes 2 are embedded in PTC conductive polymer element 1 having a hole through its center portion.

In a second class of devices, usually circuit protection devices, (A) the PTC element is in the form of a strip with substantially planar parallel ends, the length of the strip being greater than the largest cross-sectional dimension of the strip; and (B) each of the electrodes is in the form of a cap having (i) a substantially planar end which contacts and has substantially the same cross-section as one end of the PTC element and (ii) a side wall which contacts the side of the PTC element.

Figure 3:
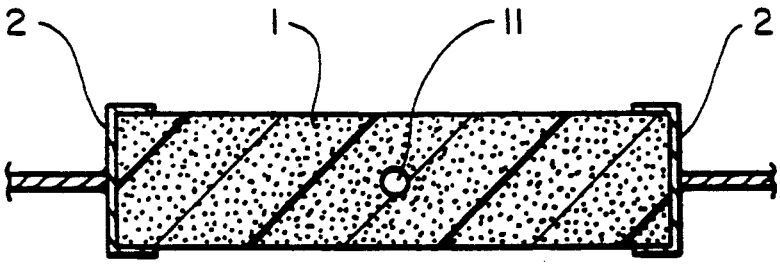

Such a device is shown in cross-section in FIG. 3, in which cap electrodes 2 contact either end of cylindrical PTC conductive polymer element 1 having a hole 11 through its center portion.

In a third class of devices, usually heaters, (A) the PTC element is laminar; and (B) the electrodes are displaced from each other so that at least a substantial component of the current flow between them is along one of the large dimensions of the element.

Figure 4:
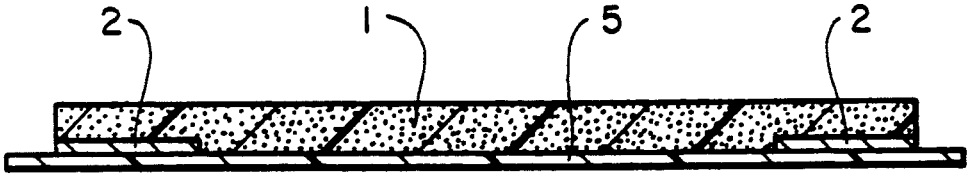

Such a device is illustrated in cross-section in FIG. 4 and comprises metal strip electrodes 2 which contact laminar PTC element 1 and insulating base 5.

Figure 5:
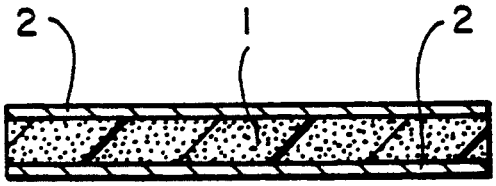
Figure 6:
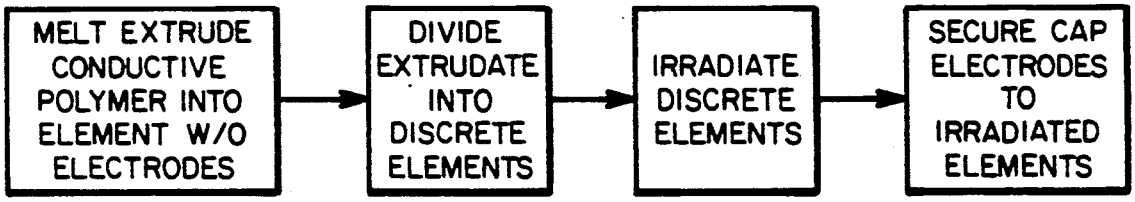
FIG. 6 is a block diagram of a process of the invention in which an electrical device is made by melt-extruding a PTC conductive polymer to form an extrudate which does not contain an electrode, dividing the extrudate into discrete PTC elements, each in the form of a strip with substantially parallel planar ends, cross-linking the conductive polymer by irradiating substantially the whole of each discrete PTC element to the desired dosage, and securing a cap electrode to each end of the discrete PTC elements.
Figure 7:
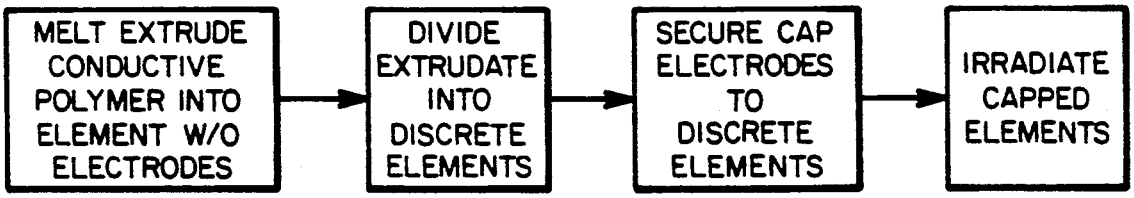
FIG. 7 is a block diagram of a process which is the same as that shown in FIG. 6 except that the cap electrodes are secured to the PTC elements before the irradiation step.

In a fourth class of devices, each of the electrodes has a substantially planar configuration. Such a device is illustrated in cross-section in FIG. 5 and comprises a laminar PTC element sandwiched between metal electrodes 2. Meshed planar electrodes can be used, but metal foil electrodes are preferred. If metal foil electrodes are applied to the PTC element before it is irradiated, there is a danger that gases evolved during irradiation will be trapped. It is preferred, therefore, that metal foil electrodes be applied after the radiation cross-linking step. Thus a preferred process comprises (1) irradiating a laminar PTC conductive polymer element in the absence of electrodes;

(2) contacting the cross-linked PTC element from step (1) with metal foil electrodes under conditions of heat and pressure, and (3) cooling the PTC element and the metal foil electrodes while continuing to press them together.

PTC conductive polymers suitable for use in this invention are disclosed in the patents and applications referenced above. Their resistivity at 23° C. is preferably less than 1250 ohm.cm, e.g. less than 750 ohm.cm, particularly less than 500 ohm.cm, with values less than 50 ohm.cm being preferred for circuit protection devices. The polymeric component should be one which is cross-linked and not significantly degraded by radiation. The polymeric component is preferably free of thermosetting polymers and often consists essentially of one or more crystalline polymers. Suitable polymers include polyolefins, e.g. polyethylene, and copolymers of at least one olefin and at least one olefinically unsaturated monomer containing a polar group. The conductive filler is preferably carbon black. The composition may also contain a non-conductive filler, e.g. alumina trihydrate. The composition can, but preferably does not, contain a radiation cross-linking aid. The presence of a cross-linking aid can substantially reduce the radiation dose required to produce a particular degree of cross-linking, but its residue generally has an adverse effect on electrical characteristics.

Shaping of the conductive polymer will generally be effected by a melt-shaping technique, e.g. by melt-extrusion or molding.

The invention is illustrated by the following Example.

EXAMPLE

The ingredients and amounts thereof given in the Table below were used in the Example.

TABLE

| | Masterbatch | | | Final Mix | | |
|---|---|---|---|---|---|---|
| | g | wt % | vol % | g | wt % | vol % |
| Carbon black (Statex G) | 1440 | 46.8 | 32.0 | 1141.5 | 33.7 | 26.7 |
| Polyethylene (Marlex 6003) | 1584 | 51.5 | 66.0 | 1256.2 | 37.1 | 55.2 |
| Filler (Hydral 705) | | | | 948.3 | 28.0 | 16.5 |

TABLE-continued

| | Masterbatch | | | Final Mix | | |
|---|---|---|---|---|---|---|
| | g | wt % | vol % | g | wt % | vol % |
| Antioxidant | 52.5 | 1.7 | 2.0 | 41.5 | 1.2 | 1.6 |

Notes:
Statex G, available from Columbian Chemicals, has a density of 1.8 g/cc, a surface area (S) of 35 $m^2/g$, and an average particle size (D) of 60 millimicrons.
Marlex 6003 is a high density polyethylene with a melt index of 0.3 which is available from Phillips Petroleum.
Hydral 705 is alumina trihydrate available from Aluminum Co. of America.
The antioxidant used was an oligomer of 4,4-thiobis(3-methyl-6-5-butyl phenol) with an average degree of polymerization of 3–4, as described in U.S. Pat. No. 3,986,981.

After drying the polymer at 70° C. and the carbon black at 150° C. for 16 hours in a vacuum oven, the ingredients for the masterbatch were dry blended and then mixed for 12 minutes in a Banbury mixer turning at high gear. The mixture was dumped, cooled, and granulated. The final mix was prepared by dry blending 948.3 g. of Hydral 705 with 2439.2 g. of the masterbatch, and then mixing the dry blend for 7 minutes in a Banbury mixer turning at high gear. The mixture was dumped, cooled, granulated, and then dried at 70° C. for 1 torr for 16 hours.

Using a cross-head die, the granulated final mix was melt extruded as a strip 1 cm. wide and 0.25 cm. thick, around three wires. Two of the wires were pre-heated 20 AWG (0.095 cm. diameter) 19/32 stranded nickel-plated copper wires whose centers were 0.76 cm. apart, and the third wire, a 24 AWG (0.064 cm. diameter) solid nickel-plated copper wire, was centered between the other two. Portions 1 cm. long were cut from the extruded product and from each portion the polymeric composition was removed from about half the length, and the whole of the center 24 AWG wire was removed, leaving a hole running through the polymeric element. The products were heat treated in nitrogen at 150° C. for 30 minutes and then in air at 110° C. for 60 minutes, and were then irradiated. Samples were irradiated to dosages of 20 Mrads, 80 Mrads or 160 Mrads. These samples, when subjected to SEM scanning, were found to have a maximum difference in voltage between two points separated by 10 microns of about 5.2, about 4.0 and about 2.0 respectively. Some of these samples were then sealed inside a metal can, with a polypropylene envelope between the conductive element and the can. The resulting circuit protection devices were tested to determine how many test cycles they would withstand when tested in a circuit consisting essentially of a 240 volt AC power supply, a switch, a fixed resistor and the device. The devices had a resistance of 20–30 ohms at 23° C. and the fixed resistor had a resistance of 33 ohms, so that when the power supply was first switched on, the initial current in the circuit was 4–5 amps. Each test cycle consisted of closing the switch, thus tripping the device, and after a period of about 10 seconds, opening the switch and allowing the device to cool for 1 minute before the next test cycle. The resistance of the device at 23° C. was measured initially and after every fifth cycle. The Table below shows the number of cycles needed to increase the resistance to 1.5 times its original value.

| Device irradiated to a dose of | Resistance increased to 1.5 times after |
|---|---|
| 20 Mrads | 40–45 cycles |
| 80 Mrads | 80–85 cycles |
| 160 Mrads | 90–95 cycles |

We claim:

1. An electrical device which comprises
(1) a radiation cross-linked PTC element which
(a) is composed of a conductive polymer which exhibits PTC behavior and which comprises a polymer component and, dispersed in the polymeric component, a particulate conductive filler comprising carbon black, and
(b) is in the form of a strip with first and second substantially planar parallel ends, the length of the strip being greater than the largest cross-sectional dimension of the strip; and
(2) a first electrode and a second electrode,
(a) the first electrode being in the form of a cap having (i) a substantially planar end which contacts and has substantially the same cross-section as the first end of the PTC element, and (ii) a side wall which contacts the side of the PTC element, and
(b) the second electrode being in the form of a cap having (i) a substantially planar end which contacts and has substantially the same cross-section as the second end of the PTC element, and (ii) a side wall which contacts the side of the PTC element; and which, when it is subjected to SEM scanning, shows a maximum difference in voltage between two points on the PTC element separated by 10 microns of less than 4.2 volts.

2. A device according to claim 1 wherein the maximum difference is less than 4.0 volts.

3. A device according to claim 2 wherein the maximum difference is less than 3 volts.

4. A device according to claim 3 wherein the maximum difference is less than 2 volts.

5. A device according to claim 4 wherein the maximum difference is less than 1 volt.

6. A device according to claim 1 which is a circuit protection device having a resistance of less than 50 ohms.

7. An electrical circuit which comprises
(a) a power source;
(b) an electrical load; and
(c) a circuit protection device which is connected electrically in series with the power source and the load and which comprises
(1) a PTC element which (i) is composed of a conductive polymer composition which exhibits PTC behavior and which comprises a polymeric component and, dispersed in the polymeric component, a particulate conductive filler comprising carbon black, substantially the whole of said PTC element having been irradiated to a dosage of at least 50 Mrads, and (ii) has first and second substantially planar parallel ends; and
(2) a first electrode and a second electrode,
(a) the first electrode being in the form of a cap having (i) a substantially planar end which contacts and has substantially the same cross-section as the first end of the PTC element, and (ii) a side wall which contacts the side of the PTC element, and (b) the second electrode being in the form of a cap having (i) a substantially planar end which contacts and has substantially the same cross-section as the second end of the PTC element, and (ii) a side wall which contacts the side of the PTC element.

8. A circuit according to claim 7 wherein the PTC element has been irradiated to a dosage of at least 80 Mrads.

9. A circuit according to claim 8 wherein the PTC element has been irradiated to a dosage of at least 120 Mrads.

10. A circuit according to claim 9 wherein the PTC element has been irradiated to a dosage of at least 160 Mrads.

11. A circuit according to claim 7 wherein the carbon black is the sole particulate conductive filler in the composition.

12. A circuit according to claim 7 wherein the polymeric component consists essentially of one or more crystalline polymers.

13. A circuit according to claim 7 wherein the polymeric component comprises a polyolefin.

14. A circuit according to claim 13 wherein the polymeric component comprises polyethylene.

15. A circuit according to claim 14 wherein the polymeric component consists essentially of polyethylene.

16. A circuit according to claim 7 wherein the cross-linked PTC conductive polymer element has a resistivity at 23° C. of less than 50 ohm-cm.

17. An electrical device which comprises (1) a PTC element which (a) is composed of a conductive polymer which exhibits PTC behavior and which comprises a polymer component and, dispersed in the polymeric component, a particulate conductive filler comprising carbon black, and (b) has first and second substantially planar parallel ends; and (2) a first electrode and a second electrode, (a) the first electrode being in the form of a cap having (i) a substantially planar end which contacts and has substantially the same cross-section as the first end of the PTC element, and (ii) a side wall which contacts the side of the PTC element, and (b) the second electrode being in the form of a cap having (i) a substantially planar end which contacts and has substantially the same cross-section as the second end of the PTC element, and (ii) a side wall which contacts the side of the PTC element, substantially the whole of said PTC element having been irradiated to a dosage of at least 50 Mrad.

18. A device according to claim 17 wherein substantially all of the device has been irradiated to at least 60 Mrads.

19. A device according to claim 18 wherein substantially all of the device has been irradiated to at least 80 Mrads.

20. A device according to claim 19 wherein substantially all of the device has been irradiated to at least 120 Mrads.

21. A device according to claim 17 wherein the conductive polymer has a resistivity at 23° C. of less than 50 ohm-cm.

* * * * *

UNITED STATES PATENT AND TRADEMARK OFFICE

CERTIFICATE OF CORRECTION

PATENT NO. : 5,140,297

DATED : August 18, 1992

INVENTOR(S) : Stephen M. Jacobs, et al

It is certified that error appears in the above-indentified patent and that said Letters Patent is hereby corrected as shown below:

Title page, item [54] and col. 1, line 1, replace "PTC CONDUCTIVE POLYMER COMPOSITIONS" by --ELECTRICAL DEVICE COMPRISING A PTC CONDUCTIVE POLYMER AND A CIRCUIT COMPRISING SAID DEVICE--.

Column 2, line 3, replace "38,173" by --38,718--.

Column 2, line 3, after "(Evans)", insert --, published as European Patent Application 38,713--.

Column 2, lines 3 to 4, replace "(Fouts et al.); U.S. Pat. No. 4,545,926" by --(Fouts et al.), now U.S. Pat. No. 4,545,926;--.

Column 2, lines 4 to 5, replace "(Middleman et al.); now U.S. Pat. No. 4,352,083" by --(Middleman et al.), now U.S. Pat. No. 4,352,083;--.

Column 2, lines 5 to 6, delete "published as European Patent No. 38,713".

UNITED STATES PATENT AND TRADEMARK OFFICE

CERTIFICATE OF CORRECTION

PATENT NO. : 5,140,297

DATED : August 18, 1992

INVENTOR(S) : Stephen M. Jacobs, et al

It is certified that error appears in the above-indentified patent and that said Letters Patent is hereby corrected as shown below:

Column 2, line 7, replace "4,317,027 (Sopory), now abandoned" by --4,317,027; 150,909 (Sopory), now abandoned--.

Column 2, line 8, replace "150,910 (Sopory); now U.S. Pat. No. 4,334,351" by --150,910 (Sopory), now U.S. Pat. No. 4,334,351;--.

Column 2, line 8 to 9, replace "150,911 (Sopory); now U.S. Pat. No. 4,318,881" by --150,911 (Sopory), now U.S. Pat. No. 4,318,881;--.

Column 2, lines 9 to 10, replace "254,352 (Taylor); now U.S. Pat. No. 4,426,633" by --254,352 (Taylor), now U.S. Pat. No. 4,426,633;--.

Signed and Sealed this

First Day of March, 1994

Bruce Lehman

*Attest:*

BRUCE LEHMAN

*Attesting Officer*

*Commissioner of Patents and Trademarks*